United States Patent [19]

Yamamoto et al.

[11] Patent Number: 4,837,103

[45] Date of Patent: Jun. 6, 1989

[54] NEGATIVE CHARGING LIQUID DEVELOPER FOR ELECTROPHOTOGRAPHY

[75] Inventors: Hirokazu Yamamoto; Akira Furukawa, both of Nagaokakyo, Japan

[73] Assignee: Mitsubishi Paper Mills, Ltd., Tokyo, Japan

[21] Appl. No.: 119,500

[22] Filed: Nov. 12, 1987

[30] Foreign Application Priority Data

Nov. 13, 1986 [JP] Japan ..... 61-271487

[51] Int. Cl.[4] ..... G03G 9/02

[52] U.S. Cl. ..... 430/115; 430/904

[58] Field of Search ..... 430/113, 114, 115, 904

[56] References Cited

U.S. PATENT DOCUMENTS 4,614,699 9/1986 Kitatani et al. ..... 430/115

4,631,243 12/1986 Podszun et al. ..... 430/115

*Primary Examiner*—John L. Goodrow

*Attorney, Agent, or Firm*—Cushman, Darby & Cushman

[57] ABSTRACT

This invention provides a negative-charging liquid developer for electrostatic photography excellent in charge stability and dispersion stability which comprises a highly insulating carrier liquid in which resin particles containing a charge control agent are dispersed, said charge control agent being a carboxylic acid amine salt which comprises a polycarboxylic acid compound insoluble in said carrier liquid and a high molecular amino compound soluble in said carrier liquid.

5 Claims, No Drawings

NEGATIVE CHARGING LIQUID DEVELOPER FOR ELECTROPHOTOGRAPHY

BACKGROUND OF THE INVENTION

This invention relates to a liquid developer for electrophotography and more particularly it relates to a liquid developer for electrostatic photography which is mainly composed of resin particles and is superior in negative charge stability and dispersion stability.

Conventional liquid developers used in the development of electrostatic charge patterns usually comprise a highly insulating carrier liquid in which are dispersed toner particles comprising a pigment such as carbon black and a resin such as an alkyd resin which imparts dispersibility and fixability. In general, these developers are not sufficient in charge characteristics or lack charge stability and hence a charge control agent such as calcium alkylsulfonate is often included.

However, these conventional liquid developers are still insufficient in charge characteristics and can afford sufficient image density only for high potential latent images. Especially, they are insufficient in charge stability and the charge characteristics may gradually change during storage for extended periods, resulting in a reduction of image density. Furthermore, their low dispersion stability causes agglomeration or settling when left to stand for a long period of time.

Further, these developers suffer from the disadvantage that offset printing plates made using these developers are insufficient in grease receptivity because of high pigment content.

Japanese Patent Unexamined Publication (Kokai) Nos. 52588/78, 54029/78 and 48738/82 disclose developers mainly composed of resin particles, which somehow overcome the above defects such as low dispersion stability, deterioration of properties with time and poor grease receptivity. However, when the resin particles disclosed in these publications are charged using charge control agents such as lecithin, calcium alkylsulfonates and polyamide resins, there often occur the problems that the particles are not charged at all, charge stability deteriorates with time and dispersion stability of the particles per se is lowered.

SUMMARY OF THE INVENTION

The object of this invention is to provide a negatively charging liquid developer for electrophotography free from the above mentioned defects seen in the conventional liquid developers.

DESCRIPTION OF THE INVENTION

The above object of this invention has been accomplished by a negatively charging liquid developer for electrostatic photography which comprises a highly insulating carrier liquid in which are dispersed resin particles having a carboxylic acid amine salt of a polycarboxylic acid compound insoluble in said carrier liquid and a high molecular amino compound soluble in said carrier liquid as a charge control agent.

The above compounds are preferably those which are represented by the following general formulas [I] and [II].

$$Z\text{-}(COOH)_n \qquad \text{General Formula [I]}$$

wherein Z denotes an aromatic ring or a heterocyclic hydrocarbon, alicyclic hydrocarbon or aliphatic hydrocarbon of 4–6 carbon atoms and n denotes a positive integer of 2–4.

Typical examples of the compounds of the general formula [I] are as follows:

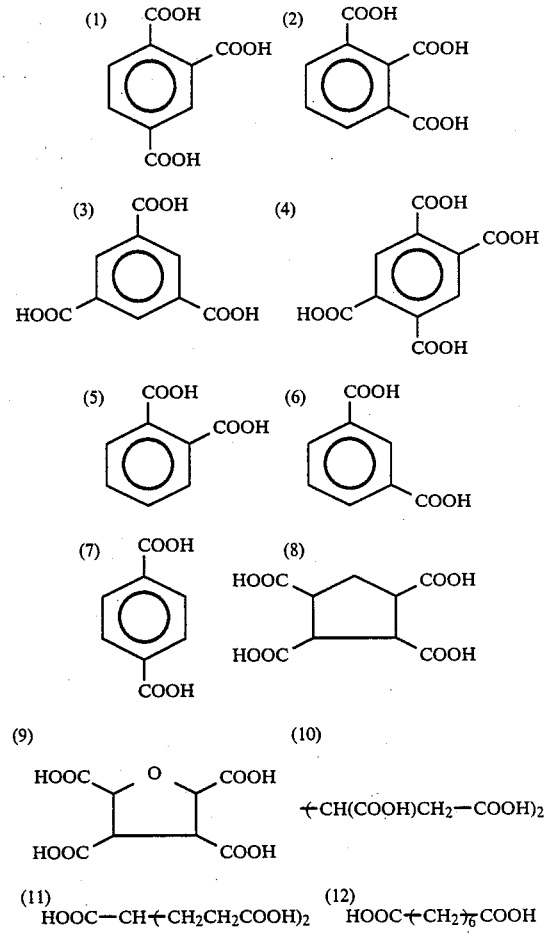

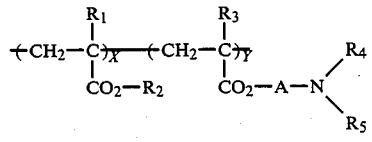

wherein $R_1$–$R_5$ each denotes a hydrogen atom or an alkyl group of 1–22 carbon atoms, A denotes an alkylene group of 1–10 carbon atoms and X and Y denote positive integers which satisfy the following relation: $Y/(X+Y)=0.01$–$0.5$.

Typical examples of the compounds of the general formula [II] are as follows:

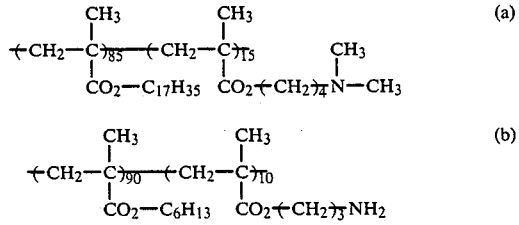

-continued

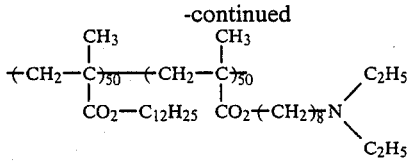

(c)

The above polycarboxylic acid compound, when used in combination with the high-molecular amino compound of the general formula [II], serves as a charge control agent which gives good negative charge to toner particles because the hydrogen atom of the carboxyl group (—COOH) undergoes deprotonation and the carboxyl group is present in the form of —COO— and thus markedly excellent charge stability is given.

The compound of the general formula [I] is insoluble or sparingly soluble in the carrier liquid. In order to add it to a carrier liquid, it is preferred to dissolve it in an organic solvent such as ethanol, butanol, dimethylformamide, butyl acetate, toluene, xylene or the like and mix the solution with a carrier solution of the compound of the general formula [II] to form a carboxylic acid amine salt soluble in the carrier liquid, which is used as a charge control agent. Or, the high molecular amino compound may be converted into the salt by adding a compound of the general formula [I] to the carrier liquid in which the high molecular amino compound has been used as the toner resin particles in place of adding it in the form of the salt previously formed to the carrier liquid.

Methods for preparing a liquid developer using the charge control agent according to this invention include various known ones such as the method which comprises mixing a colorant, a resin and a charge control agent, dispersing the mixture in a carrier liquid such as a petroleum aliphatic hydrocarbon, aromatic hydrocarbon or halogenated aliphatic hydrocarbon by a dispersing device such as attritor, ball mill or the like and diluting the resulting concentrated toner with a low permittivity and highly insulating carrier liquid, the method which comprises adding dropwise a concentrate of colorant, resin and charge control agent to the carrier liquid to obtain toner particles and the method which comprises polymerizing monomers in a low permittivity and highly insulating carrier liquid to form toner particles and then adding colorant and charge control agent thereto.

The carrier liquid used in this invention is of low permittivity and high electrical insulation and as examples thereof, mention may be made of normal paraffinic hydrocarbons, isoparaffinic hydrocarbons, alicyclic hydrocarbons, aromatic hydrocarbons, halogenated aliphatic hydrocarbons, etc. Isoparaffinic hydrocarbons are preferred and typical examples thereof are Shell Sol 71 (Shell Oil Co.), Isoper G, Isoper H, Isoper K and Isoper L (Esso Oil Co.), IP Solvent (Idemitsu Oil Co.), etc.

Toner particles suitable for use in this invention include those prepared by coloring polymer particles as disclosed in Japanese Patent Unexamined Publication (Kokai) Nos. 123138/78, 129450/82, 83174/84 and 212851/84 with colorants, for example, oil soluble azo dyes such as oil black and Oil Red, basic azo dyes such as Bismarck Brown and crysoidine, acidic azo dyes such as Wool Black, Amido Black Green and Blue Black HF, direct dyes such as Direct Deep Black E and Congo Red, anthraquinone dyes such as Sudan Violet and Acid Blue, carbonium dyes such as Auramine, Malachite Green, Crystal Violet and Victoria Blue, rhodamine dyes such as Rhodamine B, quinoneimine dyes such as Safranine, Nigrosine and Methylene Blue, etc.

The charge control agent is used preferably in an amount of 0.001–0.5 parts by weight for 1000 parts by weight of carrier liquid.

The following examples further illustrate this invention.

EXAMPLE 1

[Comparative Developer A]

500 g of IP Solvent (Idemitsu Oil Co.), 170 g of stearyl methacrylate and 30 g of dimethylaminoethyl methacrylate were charged in a 1 l flask provided with a stirrer, a thermometer and a nitrogen introducing pipe and were stirred at 75° C. for 30 minutes while introducing nitrogen. Then, 1 g of AIBN (azobisisobutyronitrile) was added as a polymerization initiator and polymerization was effected in a water bath at 75° C. for 3 hours to obtain a soluble polymer solution.

Then, 100 g of the resulting solution was transferred into a 1 l flask provided with a stirrer, a thermometer, a dropping funnel and a nitrogen introduction pipe and thereto was added 300 g of IP Solvent and a mixture of 90 g of methyl methacrylate and 10 g of acrylic acid as monomers providing an insoluble copolymer and 1 g of AIBN was added dropwise from the dropping funnel in a water bath of 75° C. over a period of 3 hours. Thereafter, the content was further heated for 3 hours in a nitrogen atmosphere and then cooled to room temperature. The product was a white emulsion comprising a composite resin dispersion of 0.2$\mu$ in average particle size and excellent in dispersion stability. Then, thereto was added dropwise a solution prepared by dissolving 5 g of Oil Black HBB in 20 g of xylene with stirring. Furthermore, 0.05 g of sodium laurinbenzene-sulfonate was added as a charge control agent and this was diluted to 50 times with IP Solvent to obtain a toner solution. The resulting solution had negative-chargeability and showed good dispersion stability.

[Comparative developer B]

A toner solution was prepared in the same manner as for the preparation of comparative developer A mentioned above except that 0.2 g of sodium dioctylsulfosuccinate was used as the charge control agent.

[Comparative developer C]

A toner was prepared in the same manner as for the preparation of comparative developer A except that 0.12 g of laurylpyridinium chloride was used as the charge control agent.

[Comparative developer D]

A toner solution was prepared in the same manner as for the preparation of Comparative developer A except that 1.5 g of lecithin was used as the charge control agent.

[The present developer 1 ]

A toner solution was prepared in the same manner as for the preparation of comparative developer A except that 0.01 g of the exemplified compound (1) was used as the charge control agent to form a carboxylic acid amine salt with the stearyl methacrylate-dimethylaminoethyl methacrylate copolymer (the exemplified compound (a)) as the resin particle component.

Charge stability of the resulting negative charging liquid developers for electrostatic photography was determined by measuring maximum reflective density obtained when using the developers which were stored for 3 days, 7 days and 14 days at 40° C. The obtained maximum reflective densities are shown in Table 1.

TABLE 1

| Developer | Just after preparation | 3 days | 7 days | 14 days |
|---|---|---|---|---|
| Comparative A | 1.32 | 1.38 | 1.49 | 1.60 |
| Comparative B | 1.30 | 1.37 | 1.50 | 1.63 |
| Comparative C | 1.38 | 1.44 | 1.55 | 1.67 |
| Comparative D | 1.31 | 1.36 | 1.48 | 1.59 |
| The present-1 | 1.35 | 1.33 | 1.34 | 1.33 |

It will be recognized from the results of Table 1 that when comparative developers A–D were used a, conspicuous change of maximum density with time was seen because of inferior charge stability while when the developers of this invention were used, substantially no change in maximum density was seen and thus the developers of this invention were very stable.

Furthermore, the developers of this invention were superior in dispersion stability and showed no deterioration of dispersion stability with time.

EXAMPLE 2

100 g of stearyl methacrylate, 10 g of methoxypolyethylene glycol methacrylate

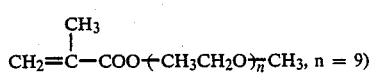

and 1.8 g of AIBN were charged in a 1 l flask equipped with a stirrer, a thermometer and a nitrogen introducing pipe and 500 g of IP Solvent was added thereto, followed by heating and stirring at 75° C. for 5 hours. To 100 g of the resulting solution were added 50 g of methyl methacrylate, 35 g of styrene, 10 g of hydroxyethyl methacrylate and 1.0 g of AIBN, followed by heating and stirring at 75° C. for 5 hours. The resulting product was a stable emulsion of 0.15μ in average particle size. Then, a solution prepared by dissolving 8 g of Oil Black HBB (manufactured by Orient Chemical Co.) in 60 g of xylene was added dropwise to the above emulsion, followed by stirring. Thereafter, a toner solution was prepared therefrom in the same manner as in preparation of comparative developer A except that a mixture of 15 g of a 20% carrier solution of the exemplified compound (a) prepared in the same manner as in the preparation of comparative developer A in Example 1 and 10 g of a solution prepared by 0.1 g of the exemplified compound (8) in butanol with heating was used as the charge control agent. This toner solution was tested in the same manner as in Example 1 to find that this was a liquid developer markedly excellent in charge stability and dispersion stability like the present Developer 1.

EXAMPLE 3

In a 1 l flask equipped with a stirrer, a thermometer and a nitrogen introducing pipe were charged 500 g of IP Solvent (Idemitsu Oil Co.) comprising isoparaffinic hydrocarbon, 100 g of lauryl methacrylate and 5 g of methacrylic acid, 1 g of BPO (benzoyl peroxide) as a polymerization initiator was added thereto. Then, polymerization was effected in a water bath at 85° C. for 5 hours to obtain a polymer solution.

Thereafter, 100 g of this solution was transferred into a 1 l flask equipped with a stirrer, a thermometer, a dropping funnel and a nitrogen introducing pipe and 300 g of IP Solvent was added thereto. Then, a mixture of 100 g of vinyl acetate, 10 g of N-Vinylpyrrolidone, 5 g of methyl acrylate (Tg 3° C.) (which were monomers providing insoluble copolymer) and 1 g of polymerization initator AIBN (azobisisobutyronitrile) was added dropwise from the dropping funnel in a water bath at 70° C. over a period of 3 hours. Then, the mixture was further heated for 3 hours in a nitrogen atmosphere and then cooled to room temperature. The product was a white emulsion comprising a dispersion of composite resin markedly superior in dispersion stability. Then, a solution prepared by dissolving 5 g of Oil Black HBB in 20 g of xylene was added dropwise to said emulsion with stirring. Then, thereto was added a charge control agent prepared in the same manner as in Example 2 except using 10 g of ethanol:xylene (2:8) solution in which 1 g of the exemplified compound (11) was dissolved in place of the exemplified compound (8) and the mixture was diluted with IP Solvent to 50 times to obtain a toner solution. The resulting toner was a negative charging toner which showed good dispersion stability and comprised uniformly dispersed particles of 0.2 μm according to observation of an electron photomicrograph.

As explained above, the liquid developers of this invention have excellent negative chargeability and dispersion stability and are markedly superior in charge stability with time.

What is claimed is:

1. A negative-charging liquid developer for electrostatic photography which comprises a highly insulating carrier liquid in which resin particles comprising a charge control agent are dispersed, said charge control agent being a carboxylic acid amine salt which comprises a polycarboxylic acid compound insoluble in said carrier liquid and a high molecular amino compound soluble in said carrier liquid.

2. A negative-charging liquid developer according to claim 1 wherein the resin particles are colored with a colorant.

3. A negative-charging liquid developer according to claim 1 wherein the polycarboxylic acid compound is represented by the general formula[I]:

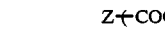

wherein Z represents an aromatic ring or a heterocyclic, alicyclic or aliphatic hydrocarbon of 4–6 carbon atoms and n indicates a positive integer of 2–4.

4. A negative-charging liquid developer according to claim 1 wherein the high molecular amino compound is represented by the general formula [II]:

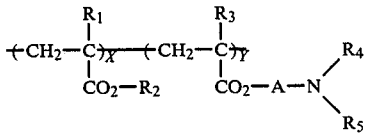

wherein $R_1$–$R_5$ each represents a hydrogen atom or an alkyl group of 1–22 carbon atoms, A represents an alkylene group of 1–10 carbon atoms and X and Y indicate positive integers which satisfy the relation $Y/(X+Y)=0.01$–$0.5$.

5. A process of developing electrostatic charge patterns carried on the surface of an electrophotographic element with the liquid developer of claim 1.

* * * * *